United States Patent [19]

Rudolph

[11] Patent Number: 4,715,207

[45] Date of Patent: Dec. 29, 1987

[54] APPARATUS FOR COVERING METALLIC BILLETS WITH ALUMINUM

[75] Inventor: Johann Rudolph, Hanau, Fed. Rep. of Germany

[73] Assignee: Vacuumschmelze GmbH, Fed. Rep. of Germany

[21] Appl. No.: 875,957

[22] Filed: Jun. 19, 1986

[30] Foreign Application Priority Data

Jun. 19, 1985 [DE] Fed. Rep. of Germany ..... 3521850

[51] Int. Cl.[4] ..... B21C 23/24

[52] U.S. Cl. ..... 72/268

[58] Field of Search ..... 72/258, 268, 269

[56] References Cited

U.S. PATENT DOCUMENTS

| | | | |
|---|---|---|---|
| 326,021 | 9/1885 | Cruickshank | 72/268 |
| 2,738,873 | 3/1956 | Emmerich | 72/268 |
| 3,137,389 | 6/1964 | Buigne | 72/268 |

*Primary Examiner*—Lowell A. Larson

*Attorney, Agent, or Firm*—Hill, Van Santen, Steadman & Simpson

[57] ABSTRACT

An extrusion device for extruding a cladding onto a core, said device having an extrusion chamber, a nozzle extending into the extrusion chamber with a nozzle opening aligned with a die opening so that a core passes through the nozzle opening and then the die opening with the material extruded thereon characterized by an arrangement to increase the friction between surfaces of the nozzle opening and the core to subsequently improve the bond and adhesion of the cladding to the core. This arrangement can include either notches formed in the nozzle opening adjacent the edges so that a portion of the core will be engaged by the extrusion material prior to the rest of the core surfaces exiting the nozzle, a groove in an end surface of the nozzle so that portions of the nozzle can be pressed onto the core or projections or blades on an internal surface of the nozzle opening.

2 Claims, 11 Drawing Figures

APPARATUS FOR COVERING METALLIC BILLETS WITH ALUMINUM

BACKGROUND OF THE INVENTION

The present invention is directed to an apparatus for extruding a cover or sheath onto a billet-like member wherein the billet can be wires, cables, bands, pipes or the like and the sheath or cladding is composed of aluminum or of an alloy of aluminum. The extruding apparatus has an extrusion chamber containing the material for the cladding, an arbor or nozzle projecting into the extrusion chamber and having a nozzle opening which is matched to a cross section of the billet and aligned with a die opening of the apparatus which die opening has a cross section corresponding to the finished cladded or sheath billet or article.

Apparatuses of the above type are usually employed for covering electrical connectors with aluminum. However, wires, cables, bands and other elongated articles can also be covered in such an extrusion device.

SUMMARY OF THE INVENTION

The object of the present invention is to provide an extrusion apparatus which will produce especially firm bonds between the billet or core and the covering sheath or cladding of the finished article.

To accomplish these goals, the present invention is directed to an improvement in an extrusion device for extruding a sheath of material selected from a group consisting of aluminum and aluminum alloys onto a billet or core which can be wires, cables, bands, pipes and the like. The extrusion apparatus includes an extrusion chamber for containing the material forming the sheath, an arbor or nozzle projecting into the molding chamber having a nozzle opening which is adapted to the cross section of the billet or core and is aligned with a die opening of a die for the chamber, said die opening having a cross section of the finished extruded article. The improvements are providing means to produce friction between inside surfaces of the nozzle opening of the nozzle and a part of the surface of the billet or core to ensure a clean surface for adhesion and bonding of the cladding material onto the core or billet.

DESCRIPTION OF THE PREFERRED EMBODIMENTS

Figure 1:
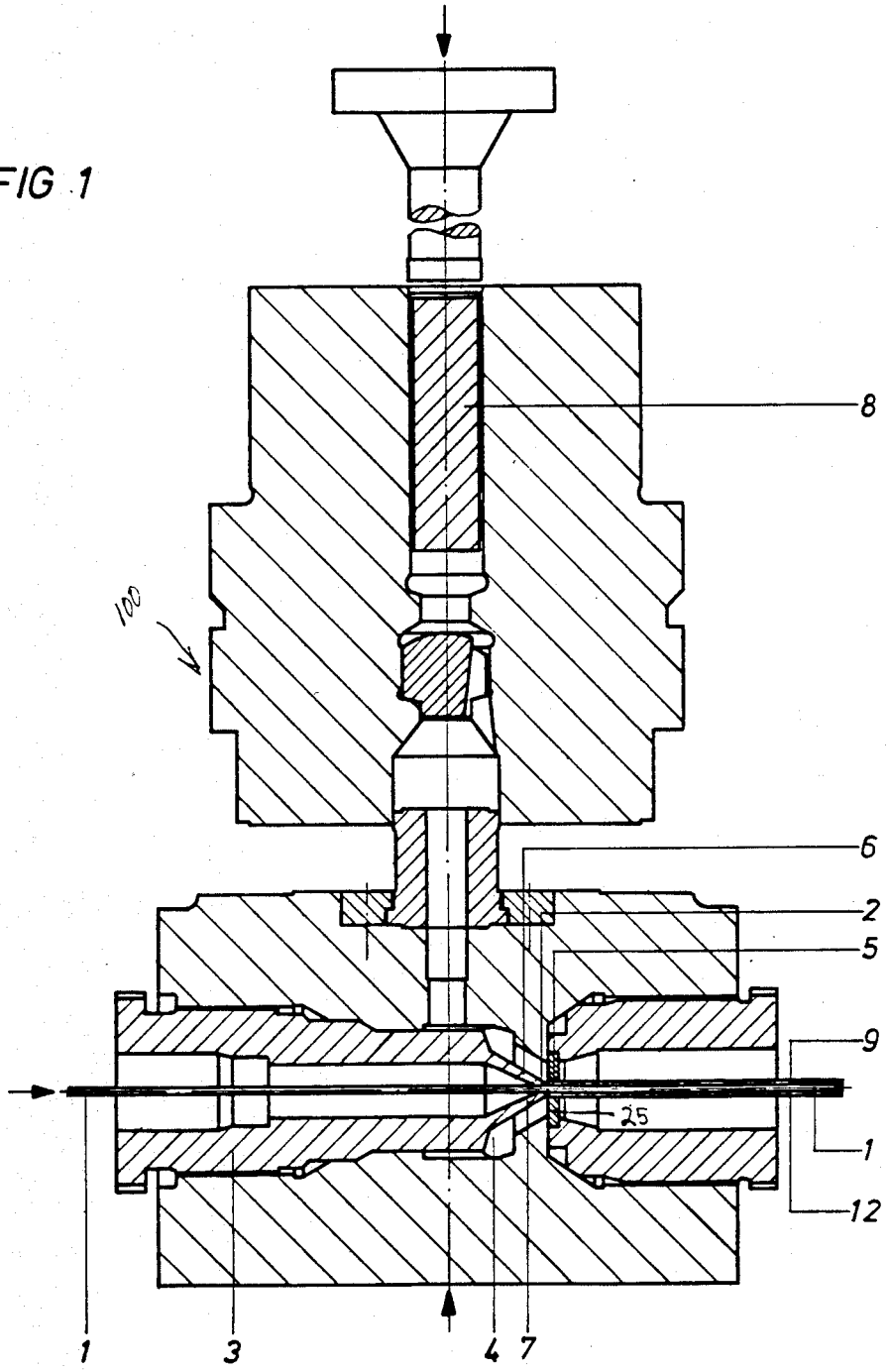
FIG. 1 is a cross sectional view of an extruding apparatus in accordance with the present invention.

The principles of the present invention are particularly useful when incorporated in an apparatus generally indicated at 100 in FIG. 1. The apparatus 100 is an extrusion apparatus for extruding a sheath 12 on a core or billet 1 to form a finished article 9.

The billet 1 can be any suitable elongated metallic article such as a cable, wire, band, pipe or strip and the metal article can either have a round cross section, a rectangular cross section or a cross section of other shapes. The sheath, which is extruded onto the outer surface of the core or billet 1, is of a material selected from a group consisting of aluminum and aluminum alloys.

The apparatus 100 has a molding or extrusion chamber 4 into which a nozzle or arbor 3 projects. The arbor or nozzle 3 is hollow and has an opening 2 which corresponds to the cross section of the core or billet 1. The extrusion chamber 4 is enclosed by a die 25 having a die opening 5 which is aligned with the opening 2 so that the billet or core 1 passes through the opening 2 and then through the die opening 5. The material for enveloping or cladding the core 1 is supplied to the chamber 4 under pressure. This is accomplished by a pressure cylinder 8 which squeezes the material through the various passages and into the chamber 4 which surround the end of the nozzle or arbor 3 and to be extruded with the billet through the die opening 5. The die opening 5 will have a cross section which is the same as the final cross section of the finished article 9 which may be a conductor.

Figure 2:
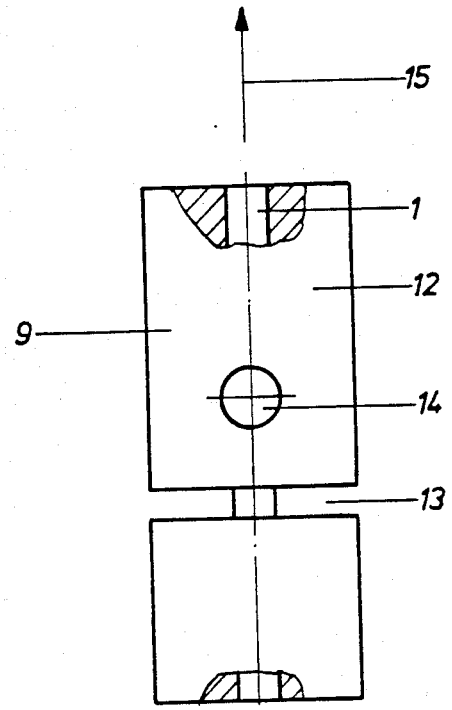
FIG. 2 is a side view with portions broken away for purposes of illustration of a test sample formed from an article produced in the apparatus of FIG. 1.

A sample is formed from an aluminum covered superconductor as illustrated in FIG. 2 and has the core 1 with the sheath 12. In order to be able to measure the bond between the core and the sheath, a portion of the finished conductor 9 is prepared as follows. Material of the sheath 12 is removed by means of an incision or cut 13 at a location and a bore 14 is formed through the sheath and core at a distance of 10 mm from the cut 13. Since the bore 14 completely severs the core 1, a 10 mm portion of the core is bonded to the cladding between the cut 13 and the bore 14. The sample is then subjected to a tension force in the direction of the arrow 15 and the strength of the bond between the billet and the sheath can, therefore, be measured.

The purpose of the present invention is to provide means for boosting the friction between a surface of the core or billet 1 and a surface of the nozzle opening 2 as they are passes through the nozzle opening 2 to improve the bond between the core or billet 1 and the sheath 12. These means are applied to the nozzle opening 2 and are present in various embodiments illustrated in FIGS. 3–11.

Figure 4:
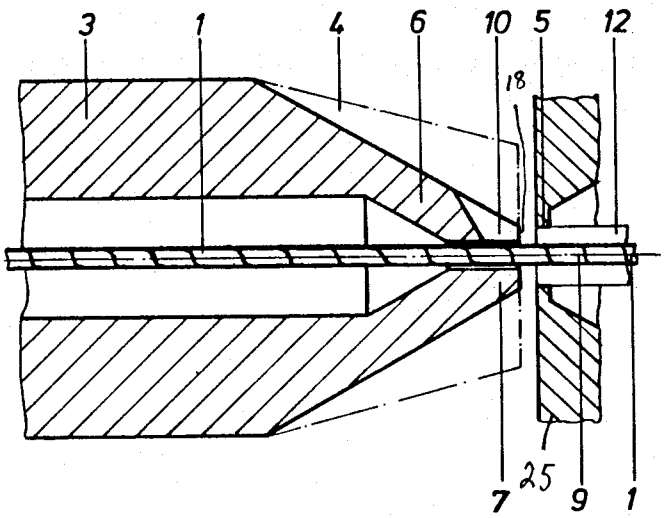
FIG. 4 is a cross sectional view taken along lines IV—IV of FIG. 3.
Figure 3:
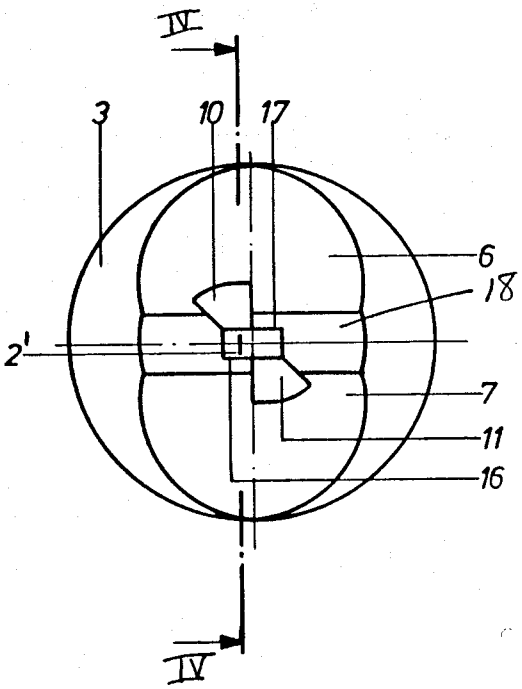
FIG. 3 is an end view of an embodiment of a nozzle utilized in the apparatus of FIG. 1.

In the embodiment illustrated in FIGS. 3 and 4, the arbor or nozzle 4 has a nozzle opening 2' which has a rectangular cross section. As illustrated, the nozzle opening 2' is formed by converging wall portions 6 and 7 which merge with an end surface 18. The means for increasing friction include troughs or notches 10 and 11 formed in the wall portions 6 and 7 adjacent the end surface 18 so that the nozzle opening will have an irregular edge facing the die opening 5 with the edge of the nozzle opening 2' having different distances from the die opening 5. As illustrated, the notches 10 and 11 are placed diagonally opposite one another so that the nozzle opening in the upper left hand side, as illustrated in FIG. 3, and the lower right hand side are different than the openings in the upper right hand and lower left hand portions. Due to the presence of the notches, the material in the extrusion chamber 4, which material is under high pressure, will act on opposite sides of the core as it passes through the nozzle opening 2' and thus, urge the core into contact with opening surfaces 16 and 17 because of the high pressure prevailing in the extrusion chamber. High friction between the parts of the billet cross section and the adjacent nozzle surfaces 16 and 17 will arise immediately before the emergence of the core into the extrusion chamber. As a result of the high frictional engagement, surface portion of the core 1 is completely freed of oxide layers and impurities at the appertaining parts of the core or billet's cross section so that an improved bond between the sheath or cladding 12 and the billet or core 1 will occur at those portions of the surface of the core.

Figure 5:
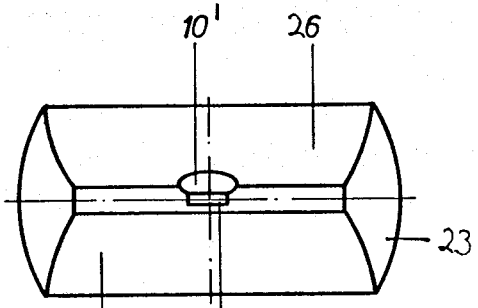
FIG. 5 is an end view of another embodiment of the nozzle utilized in the apparatus of FIG. 1.
Figure 6:
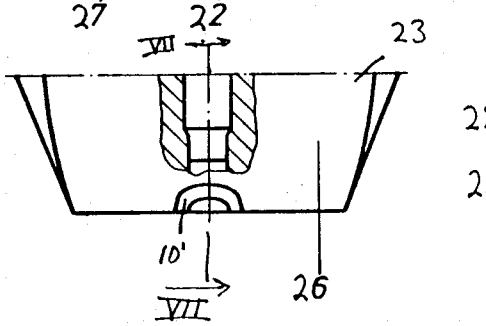
FIG. 6 is a partial top plan view with portion broken away of the nozzle of FIG. 5.
Figure 7:
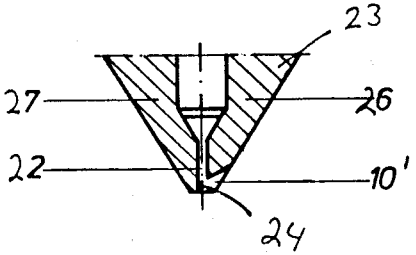
FIG. 7 is a cross sectional view taken along lines VII—VII in FIG. 6.

An embodiment of the nozzle is shown by the nozzle 23 in FIGS. 5–7. The nozzle 23 has a nozzle opening 22 which has a rectangular configuration. The nozzle opening 23 again is formed by tapering side walls 26 and 27 which end in a planer end wall 28. In this embodiment, only a single notch or trough 10' is formed which causes one edge of the opening 22 to be at a different distance from the die nozzle than the remaining edges. Because of the notch or trough 10', the core will be forced against the opposite surface 24 as it passes through the nozzle 22. This will result in a considerably improved bond between the cladding and the core on the surface engaging the surface 24.

Figure 8:
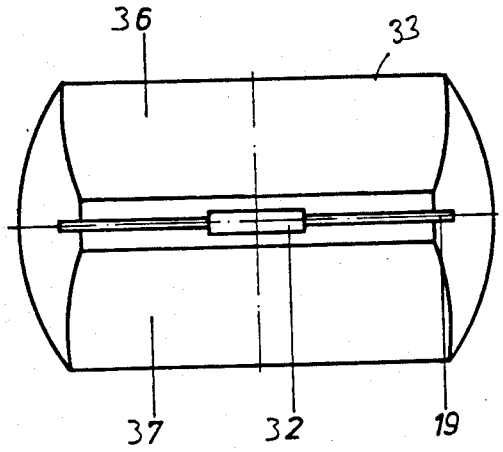
FIG. 8 is a end view of yet another embodiment of a nozzle utilized in the apparatus of FIG. 1.
Figure 9:
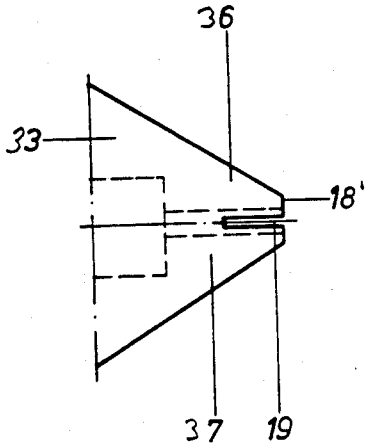
FIG. 9 is a side view of the nozzle of FIG. 8.

Another embodiment of the nozzle is illustrated by a nozzle 33 in FIGS. 8 and 9. In this embodiment, the nozzle 33 has side walls 36 and 37 merging in an end face 18' with a rectangular nozzle opening 32 being defined with a constant edge distance on the end face 18'. However, a slot 19 is formed in the end face 18' and extends through the nozzle opening 32. The effect of the slot 19 is that the ends of the walls 36 and 37 can be pressed towards each other to grip opposite surfaces of the core passing therethrough because of the pressure prevailing in the extrusion chamber. This urging of the nozzle opening onto the core will cause an increased friction on the surface of the core.

Figure 10:
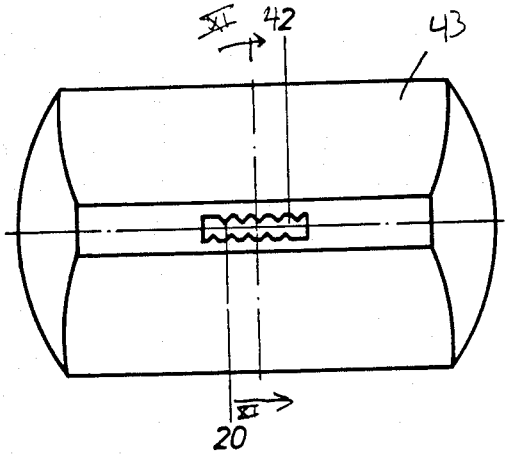
FIG. 10 is an end view of a fourth embodiment of a nozzle utilized in the apparatus of FIG. 1.
Figure 11:
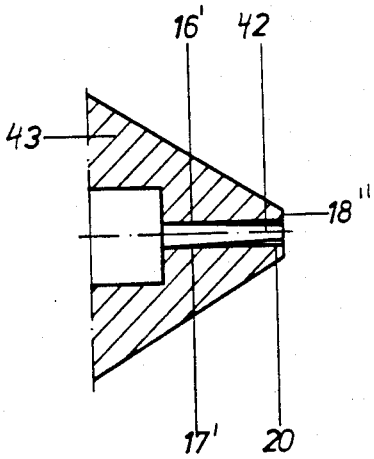
FIG. 11 is a cross sectional view taken along lines XI—XI of FIG. 10.

A fourth embodiment of the nozzle is generally indicated at 43 in FIG. 10 and has a nozzle opening 42. The nozzle 43 has a rectangular opening 42 which extends to an end face such as 18". As illustrated, the opening formed at the end face 18" has a plurality of projections or blades 20 extending inward from the two nozzle surfaces 16' and 17'. Each of the blades or projections 20 has a tapered configuration, which is illustrated in FIG. 11 and has a continually increasing heighth as the projections approach the end face 18". This will cause an increasing of the friction between the core or billet as it passes through the opening 42. With the increased adhesion being at those points engaged by the blades or projections 20.

When testing a specimen as illustrated by the sample in FIG. 2, which was produced by a know apparatus such as illustrated in FIG. 1, a pull-out strength in the range of 13 megapascals is obtained. By utilizing the nozzle 3 illustrated in FIGS. 3 and 4 having the two troughs 10 and 11 lying opposite one another in the region of the opening 2', the billet adheres so firmly to the enveloping or cladding aluminum that the conductor can not be pulled from the sheath in the test but rather the aluminum of the sheath will first rupture before separating from the core. For this reason, a modified specimen having a distance of only 5 mm between the bore 14 and the cut 13 is produced and one sample which was produced with the nozzle 43 of FIGS. 10 and 11 did not tear until a strain of 30 megapascals was applied.

These test results show that quite considerable improvement in the bond between the core of billet 1 and the sheath or cladding 12 can be achieved with a simple means for increasing the friction between a surface of a billet 1 and the inside surfaces such as 16 and 17 of the nozzle opening 2 directly at the location of emergence of the core from the nozzle 3.

Although various minor modifications may be suggested by those versed in the art, it should be understood that I wish to embody within the scope of the patent granted hereon, all such modifications as reasonably and properly come within the scope of my contribution to the art.

I claim:

1. In an apparatus for extruding a sheath onto a core, said core being selected from wires, cables, bands, pipes and the like, said sheath being composed of a material selected from a group consisting of aluminum and aluminum alloys, said apparatus having an extrusion chamber containing the material for the sheath, a nozzle projecting into the extrusion chamber and having a nozzle opening adapted to a cross section of the core and being aligned with a die opening in a die of the chamber with the die opening being adapted to the cross section of the finished extruded article, the improvements comprising means for producing friction between an inside surface of the nozzle opening and the surfaces of the core as the core passes through the nozzle opening of the apparatus, said means for forming friction comprising providing internal projections on a surface of the nozzle opening, said projections having a continual increasing height adjacent an end face of said nozzle.

2. In an apparatus for extruding a sheath onto a core, said core being selected from wires, cables, bands, pipes and the like, said sheath being composed of a material selected from a group consisting of aluminum and aluminum alloys, said apparatus having an extrusion chamber containing the material for the sheath, a nozzle projecting into the extrusion chamber and having a nozzle opening adapted to a cross section of the core and being aligned with a die opening in a die of the chamber with the die opening being adapted to the cross section of the finished extruded article, the improvements comprising means for producing friction between an inside surface of the nozzle opening and surfaces of the core as the core passes through the nozzle opening of the apparatus, said means for increasing friction comprising a groove cut in an end face of the nozzle and intersecting the nozzle opening so that adjacent wall portions of said nozzle are resiliently pressed against the core passing through the nozzle opening in response to the pressure of the cladding material in the extrusion chamber.

* * * * *